United States Patent [19]

Walden

[11] 3,930,623

[45] Jan. 6, 1976

[54] PACKAGE SUPPLY DEVICE

[75] Inventor: Richard I. Walden, Warwick, R.I.

[73] Assignee: Leesona Corporation, Warwick, R.I.

[22] Filed: Dec. 23, 1974

[21] Appl. No.: 536,019

[52] U.S. Cl. ..... 242/131

[51] Int. Cl.[2] .. B65H 49/02; D03J 5/08; D02H 1/00

[58] Field of Search ..... 242/131, 131.1, 132, 128, 242/129, 129.5, 35.6 R, 35.6 E

[56] References Cited

UNITED STATES PATENTS

| | | | |
|---|---|---|---|
| 3,081,045 | 3/1963 | Pitts et al. | 242/35.6 |
| 3,815,844 | 6/1974 | Wright et al. | 242/128 |

FOREIGN PATENTS OR APPLICATIONS

| | | | |
|---|---|---|---|
| 500,122 | 1/1971 | Switzerland | 242/131 |
| 1,297,459 | 5/1962 | France | 242/131 |

*Primary Examiner*—Leonard D. Christian
*Attorney, Agent, or Firm*—Burnett W. Norton

[57] ABSTRACT

This invention relates to an indexing supply creel of novel construction that automatically indexes either fully or partially wound packages to a winding spindle of an automatic winding machine. The supply creel construction has particular utility in handling the large packages resulting from production on open end spinning process machines.

7 Claims, 4 Drawing Figures

PACKAGE SUPPLY DEVICE

BACKGROUND OF THE PRESENT INVENTION

U.S. Pat. No. 3,081,045 to Pitts et al discloses portions of an automatic winding machine having means for rotating a delivery package to wind the yarn thereon, an unwinding station, a reserve station and means for uniting yarn from such reserve station to yarn on the delivery package upon a signal created by the absence of an active yarn winding end at the unwinding station. Also disclosed therein is an automatic package replenishing mechanism for presenting a fresh supply package of yarn to an active position for winding on the delivery package upon exhaustion of a similar such supply package. The automatic package supply device of the present invention is useful with automatic winding machines of the type therein described and has particular usefulness in handling large and extremely large packages such as result from open end spinning processes. Accordingly, U.S. Pat. No. 3,081,045 is herewith expressly incorporated by reference as part of the subject disclosure to insure a more full understanding of the environment in which the present invention operates.

With such large packages it is not possible to utilize the supply package indexing mechanism disclosed in the aforesaid patent. Thus the present supply creel construction was developed so as to assure an orderly presentation of large supply packages which in turn supply an active unwinding yarn to the unwinding station of an automatic winding machine such as disclosed in the above referred to patent. The subject creel also serves to present a reserve yarn supply package for supplying yarn to the reserve station of such an automatic winding machine and further thereafter serves to sequentially advance said reserve yarn to the active unwinding position and said active unwinding yarn to a reserve position upon a signal created by the absence of an active unwinding yarn at the unwinding station. The absence of such yarn could be brought about by either the exhaustion of the active supply package of yarn or by a break in said yarn between the yarn supply and the unwinding station. In either case, the package supply device of the present invention indexes so as to assure a continual supply of yarn to the unwinding station of the automatic yarn winding machine.

Since such automatic yarn winding machines are limited in physical construction as to the amount of space which can be afforded to a supply creel or related device it is necessary that the device accomplish the aforementioned results in the limited space frame available and to further enable an operator to conveniently replace an exhausted yarn package and thread up a substitute yarn package to the reserve position of the machine without interruption of the unwinding cycle.

Figure 1:
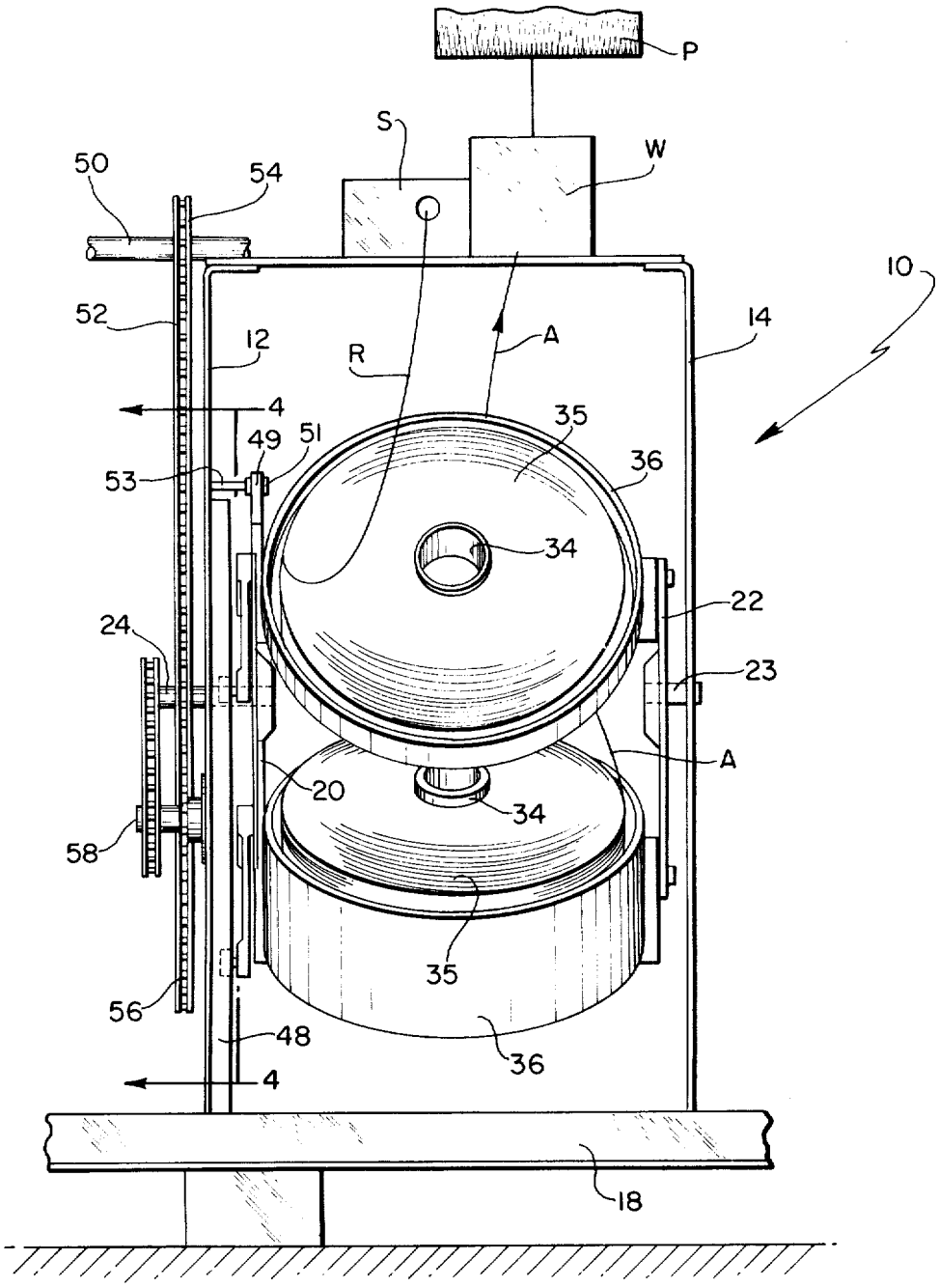

Such objects are accomplished by the automatic package supply device of the subject invention as is disclosed in the various figures of the drawings wherein:

FIG. 1 is a front elevational view of the automatic supply device of the present invention which in addition schematically shows its relationship to an automatic yarn winding machine such as the automatic yarn winding machine disclosed in U.S. Pat. No. 3,081,045.

Figure 2:
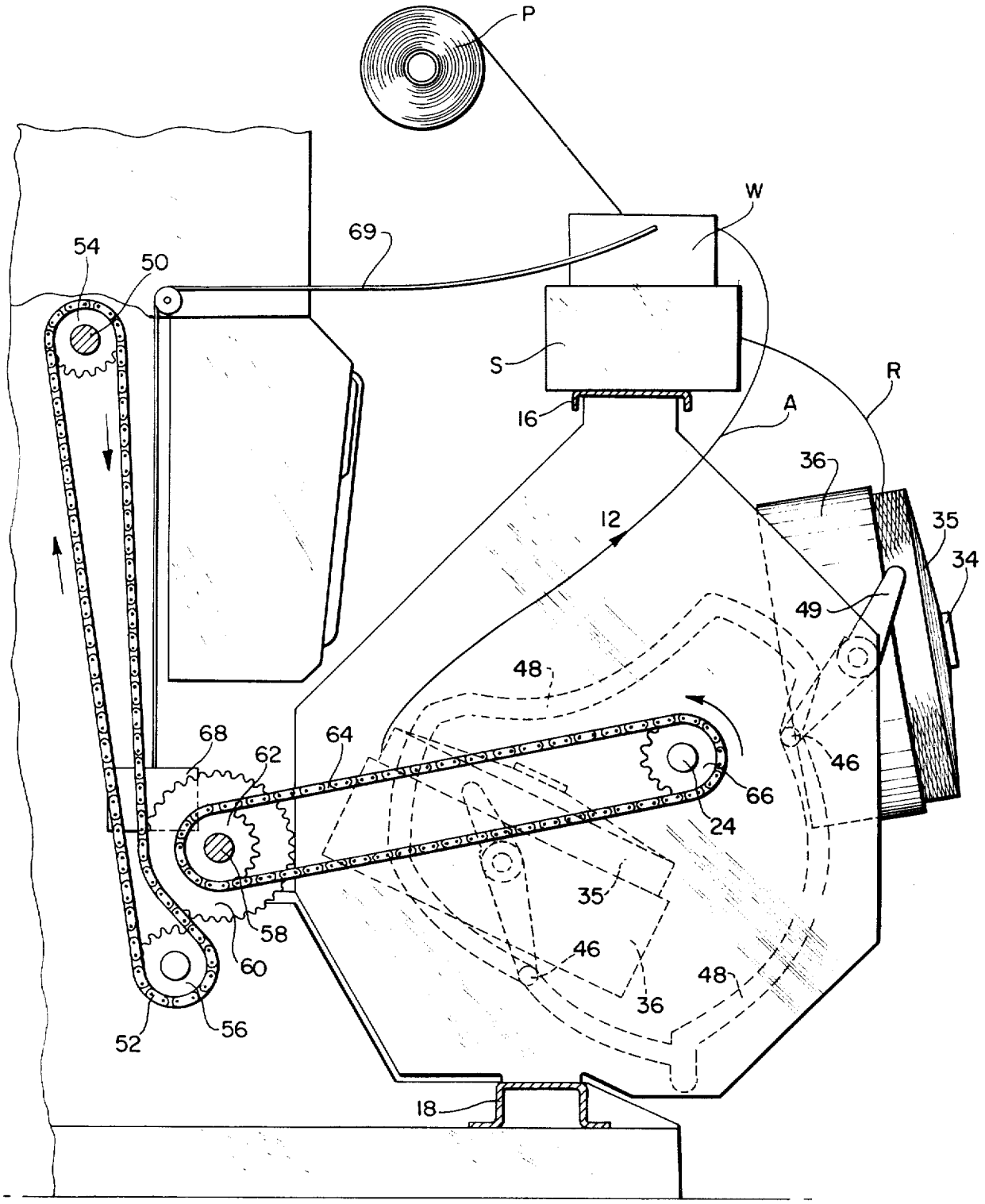
Figure 4:
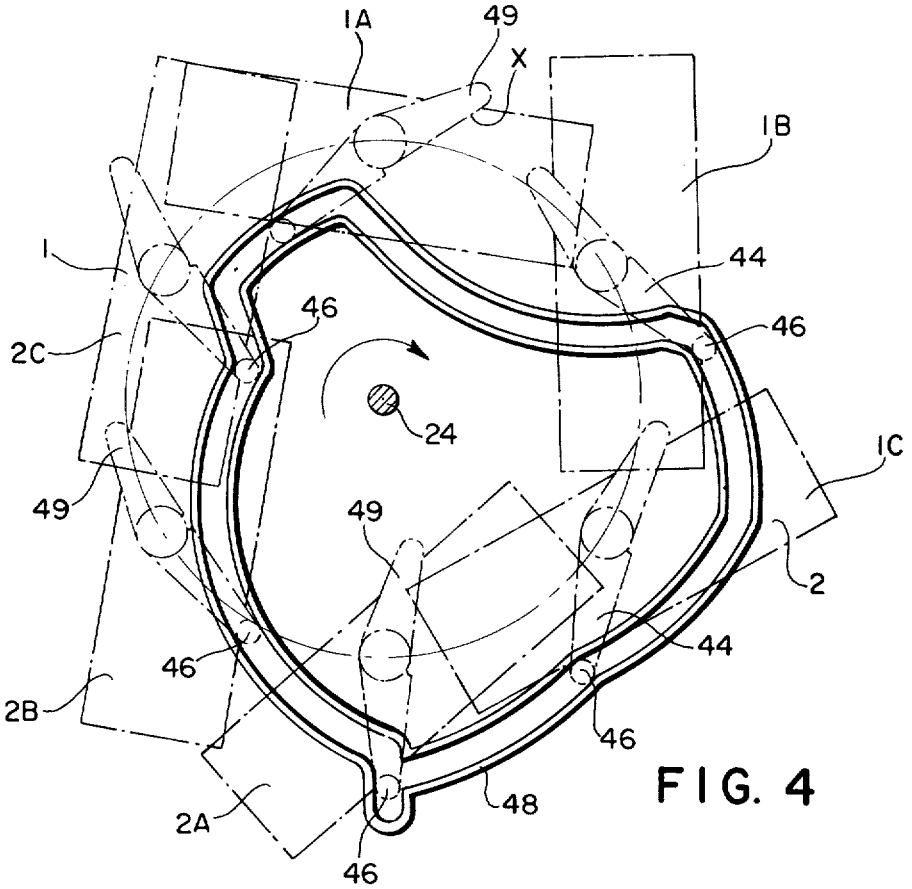
Figure 3:
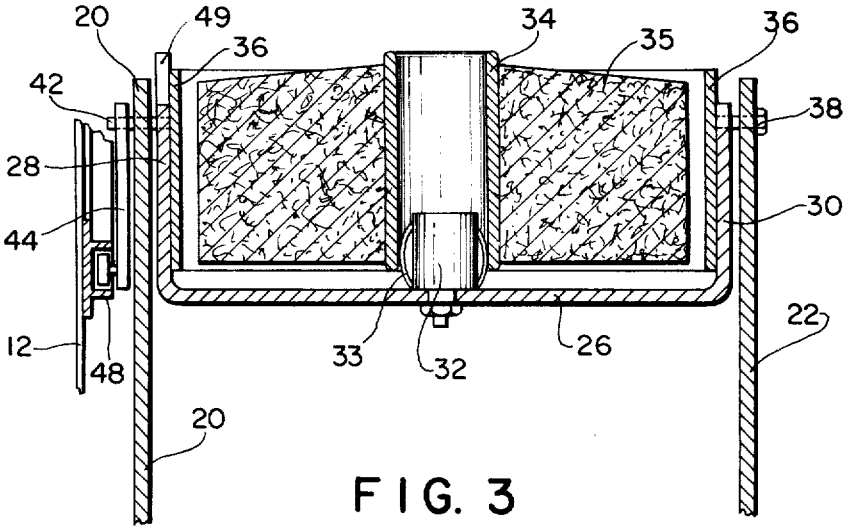

FIG. 2 is a side elevational view thereof with parts removed for clarity, and shows in particular and in partial schematic format the gear and clutch mechanisms for cycling the supply packages from active to reserve positions;

FIG. 3 is a detail sectional view on an enlarged scale showing the construction of the yarn package supports and the cam and cam follower assembly adapted to in conjunction with the cam to enable the yarn packages to be conveniently presented to the winding station within the physical space limitations of an automatic yarn winding machine; and FIG. 4 is an enlarged partially schematic view taken along lines 4—4 of FIG. 1 of the cam track of the present invention showing the various positions through which the yarn supply package supports take in presenting yarn packages from an active unwinding position to an inactive supply position.

Turning now to the drawings and more particularly to FIG. 1 thereof, the automatic package supply device 10 is shown at one position of an automatic winding machine wherein an active unwinding yarn end A is shown positioned for winding on package P through a winding station W and a reserve yarn end R positioned in a reserve station S. The winding and reserve stations of the automatic yarn winding machine may be those as are disclosed in the aforementioned Pitts et al U.S. Pat. No. 3,081,045. In practice the winding and reserve stations depicted are one of many positions of an automatic yarn winding machine, each such position having its own automatic package supply device to assure continual supply of yarn to be wound.

The automatic package supply device 10 is supported by first and second side plates 12 and 14 respectively. These side plates are positioned in spaced parallel relationship to each other and serve to support the device 10 as will be more clearly hereinafter brought forth. The side plates 12 and 14 may be in turn supported by main support portions of the automatic winding machine such as depicted in FIG. 2 of the drawings and including braces 16 and 18 respectively. The device 10 further includes a pair of vertically orientated spaced carriers 20 and 22, which are positioned for rotation around a fixed axis by means of fixed attachment to shafts 23 and 24 which are in turn journalled in openings provided in side plates 12 and 14 respectively. Yokes 25 are in turn swingably mounted at opposite ends of such carriers; each yoke including a straight bottom panel 26 and two upstanding arms or sides 28 and 30 respectively. The bottom panel 26 is further provided with a yarn package holder 32 of conventional design and may include springs or prongs 34 assuring a snug retention of a yarn package core 34 supporting yarn package 35 within the confines of a cylindrical enclosure or guard 36 which is in turn fixed to inside portions of the yoke arms 28, 30 and move as a unit therewith.

A headed shaft 38 suitably journalled in an opening in the carrier 22 extends into an opening in the upstanding side 30 of each of the yokes 25 and is fixedly attached thereto by means of a set screw 40. A similar arrangement is utilized to mount the remaining side of each yoke 25 to the carrier 20, with the exception that the outer end of a similar shaft 38 instead of being provided with a headed configuration is keyed as at 42 or is otherwise affixed to a follower arm 44 downwardly depending therefrom and provided at its lower end with a cam follower 46. As will be best seen by reference to FIG. 2, each of the cam followers of the pair of yokes 25 are engaged with an endless cam track 48 affixed to the inside of the first side plate 12. In addition each cam follower arm 44 at its opposite end is provided with an extension 49 for engagement with a roller 51 positioned inwardly from side plate 12 by means of a pin 53. A package of yarn is supported on each of the pair of yokes 34 within enclosures 36. In addition since each yoke is disposed 180° from each other in their subsequent travel orbit a revolution of 180° of the carriers will bring about a repositioning of that package having the active unwinding end to the reserve position and the package in the reserve position to a position for producing an active unwinding end.

Such movement of the carriers is supplied by means of a series of gear connections to shaft 24 it being understood that shaft 24 is as shaft 23 attached to respective carriers 20 and 22, proximate the inward extremeties thereof.

Such gearing includes a constantly rotating power shaft 50 running the length of the automatic winding machine and through which motion is constantly imparted through chain drive 52 by means of gears 54 and 56 over which the chain 52 is trained. An additional shaft 58 supports gear 60 to which gear 62 is attached. A further chain 64 is trained over gears 62 and a gear 66 which is in turn attached to aforementioned shaft 24. Upon a signal created by the absence of an active unwinding yarn A at the unwinding station W a clutch mechanism 68 of known construction is engaged through known linkage (which may include activation by non-mechanical including electrical) to shift the position of shaft 58 from an initial unengaged position into the active engaged position shown in FIG. 1 for a predetermined length of time, dependent on the speed of the chain drive system, so as to rotate carrier 20 and in turn carrier 22 through an arc of 180°. Such movement of the carriers 20, 22 in turn serves to move each of the yokes 25 along a path determined by the cam track 48 through contact with each of their follower arms 44.

Turning now to FIG. 4 of the drawings, the various attitudes assumed by each set of yokes 25 while moving their respective yarn packages from an unwinding position to a reserve position and vice versa will be described. It should be noted that FIG. 4 is viewed from the direction opposite to that from which FIG. 2 is taken and thus the various modes through which the packages move will be in a rotational direction opposite to that shown in FIG. 2.

As can be seen cam track 48 is comprised of various configured path portions in such a manner so as to enable the shifting of a package held within a particular yoke 25 from an active position to a reserve position in a limited amount of space, that is so as to insure that the lattermost extent of the yokes, the yarn package and its surrounding guard 36 as they rotate about shaft 24 will not interfere with portions of the automatic winding machine with which the supply creel device 10 of the present invention is utilized. Thus the yoke, package and guard is represented by the various phantom line rectangles in FIG. 4 wherein reference numeral 1 represents the reserve or supply position of such reference numeral 2 the active unwinding position and positions intermediate thereof 1A, 1B and 2A and 2B respectively.

Operation is as follows: upon the lack of an active unwinding yarn A at the winding station W shaft 24 is rotated as previously described about an arc of 180° thus in turn activating the rotation of the carriers 20, 22 and the two yoke, package and guard groups 1, 2, hereinafter referred to as packages for clarity. Thus the reserve package 1 upon initiation of the clockwise rotation as viewed in FIG. 4 assumes a following position through position 1A and towards position 1B through an arc of about 100° whereupon the leading surface X of the cam follower arm extension 49 engages roller 51 causing package 1 to pivot in a clockwise direction to allow its associated follower arm 44 to assume a leading attitude which is maintained while package 1 passes through position 1B and reaches position 1C which is that previously occupied by active package 2. It can be seen that the pivoting of package 1 as indicated enables the outward face of the package to retain its uppermost orientation when in position 2 thus assuring proper active yarn unwinding yarn feed therefrom to the winding station.

Simultaneously with the above described movement package 2 initially assuming a leading position moves through position 2A roughly corresponding in time span to position 1A for package 1 and thereupon into the lowermost lost motion path portion provided in the cam track 48 during the time frame in which package 1 is being pivoted about roller 51. Thereafter the follower arm 44 of package 2 assumes a trailing position through position 2B until it reaches position 2C which is that previously occupied by reserve package 1 whereupon the empty core 34 may be replaced with a fresh package 35. In those cases where the active unwinding yarn package was not exhausted e.g. when the lack of an active unwinding yarn at the winding station was caused by a yarn break replacement would not be necessary. In either case however the operator would unwind a portion of the reserve yarn and place such in the reserve position S of the automatic winding machine. During each cycle the reserve yarn is grasped and repositioned as an active unwinding yarn as disclosed in the aforementioned Pitts et al patent and thus maintains an unbroken connection with the unwinding machine during the cycling of its package from the reserve position to the active position.

What is claimed is:

1. An automatic package supply device for presenting a fresh package of yarn for winding to an automatic winding machine having means for rotating a delivery package to wind yarn thereon, an unwinding station, a reserve station and means for uniting yarn from said reserve station to yarn on said delivery package upon a signal created by the absence of an active unwinding yarn end at said unwinding station comprising;

a pair of side supporting members, an endless cam track mounted on one of said supporting members, a pair of parallel vertically orientated carrier plates supported by said supporting members for rotation about a horizontal axis, a pair of package supporting members mounted in opposed relation on said carrier plates for independent swingable movement therebetween, each of said members having a cam follower fixedly mounted therewith on one side thereof, each of said cam followers having a cam in turn engaged with said cam track, each of said members adapted to receive a yarn package wherein a first member supports a package having yarn in an active unwinding position and the second member supports a package having yarn in a reserve position and, means for rotating said carrier plates a fixed arc upon said signal whereupon said pair of members move in different cam controlled attitudes to present said first member to a reserve position and said second member to an active position.

2. The automatic package supply device as set forth in claim 1 wherein said pair of package supporting members each comprise a generally U-shaped yoke, each of said yokes being journalled in said carrier plates at opposite ends thereof.

3. The automatic package supply device as set forth in claim 2 wherein each of said yokes comprises a straight bottom panel and upstanding arms, said yokes being journalled through upper terminal portions of said arms.

4. The automatic package supply device as set forth in claim 3 wherein a cylindrical package guard is fixed to each of said yokes interiorly of said upstanding arms and each of said bottom panels are provided with an upstanding holder for receipt of a yarn package.

5. The automatic package supply device as set forth in claim 1 wherein each of said yoke arms proximate said cam is provided with an upper extension and wherein a pin inwardly extending into the rotational path of said extension is provided whereby said extension contacts said pin during the rotational movement of said yoke from its reserve position to its active position so as to permit the cam of said pin contacting yoke to change its attitude in relationship to the other and non pin contacting yoke.

6. The automatic package supply device as set forth in claim 5 wherein said change of attitude is from following to leading.

7. The automatic package supply device as set forth in claim 1 wherein said cam track presents a tortuous path and wherein the directional orientation of the yarn supplying upper face of each package received in said members is maintained during rotational cycling.

* * * * *